US010762882B2

(12) United States Patent
Jeong

(10) Patent No.: US 10,762,882 B2
(45) Date of Patent: Sep. 1, 2020

(54) LIGATURE FOR A WIND INSTRUMENT

(71) Applicant: Leto R&D Corporation, Hackensack, NJ (US)

(72) Inventor: Man Soon Jeong, Closter, NJ (US)

(73) Assignee: LETO R&D CORPORATION, Hackensack, NJ (US)

( * ) Notice: Subject to any disclaimer, the term of this patent is extended or adjusted under 35 U.S.C. 154(b) by 552 days.

(21) Appl. No.: 14/792,767

(22) Filed: Jul. 7, 2015

(65) Prior Publication Data

US 2017/0011721 A1 Jan. 12, 2017

(51) Int. Cl.
*G10D 9/02* (2020.01)
*G10D 7/06* (2020.01)
*G10D 7/066* (2020.01)

(52) U.S. Cl.
CPC ..... *G10D 9/02* (2013.01); *G10D 7/06* (2013.01); *G10D 7/066* (2013.01)

(58) Field of Classification Search
CPC G10D 9/02; G10D 9/023; G10D 7/06; G10D 7/066
USPC ..... 84/383 R
See application file for complete search history.

(56) References Cited

U.S. PATENT DOCUMENTS 555,561 A * 3/1896 Cadwallader ..... G10D 9/02 84/383 R
2,483,327 A * 9/1949 Stalowski ..... G10D 9/02 84/383 R
4,056,997 A * 11/1977 Rovner ..... G10D 9/02 84/383 R
4,185,535 A * 1/1980 Lorenzini ..... G10D 9/02 84/383 R
4,258,604 A * 3/1981 Giokas ..... G10D 9/02 84/383 R
4,347,776 A * 9/1982 Grass ..... G10D 9/02 84/383 R
4,428,271 A * 1/1984 Winslow ..... G10D 9/02 84/383 R
4,796,507 A * 1/1989 Stibal ..... G10D 9/02 84/383 A
5,289,752 A * 3/1994 Barbaglia ..... G10D 9/02 84/383 R
5,398,582 A * 3/1995 Smith ..... G10D 9/02 84/383 R (Continued)

FOREIGN PATENT DOCUMENTS

JP 6044190 6/1999
KR 10-2013-0148381 4/2014
WO 8500916 2/1985

OTHER PUBLICATIONS

KIPO, Notice of Patent Allowance dated Apr. 7, 2014 in Korean Patent Application No. 10-2013-0148381.

*Primary Examiner* — David S Warren
*Assistant Examiner* — Christina M Schreiber
(74) *Attorney, Agent, or Firm* — Kim IP Law Group PLLC

(57) ABSTRACT

A ligature for a wind instrument is provided. The ligature includes a cord harness having a plurality of apertures extending transverse to a longitudinal axis of the cord harness, and an adjuster. The adjuster is connected to and extends transverse to the longitudinal axis of the cord harness. The ligature further includes a cord passing through the plurality of apertures in a spiral manner and engages a distal end of the adjuster.

23 Claims, 6 Drawing Sheets

(56) References Cited

U.S. PATENT DOCUMENTS

| | | | | |
|---|---|---|---|---|
| 5,648,623 | A * | 7/1997 | Silverstein | G10D 9/02 84/383 R |
| 5,728,957 | A * | 3/1998 | Valtchev | G10D 9/02 84/383 R |
| 7,169,993 | B2 * | 1/2007 | Fliegel | G10D 9/02 84/383 A |
| 8,217,248 | B1 * | 7/2012 | Feliciano | G10D 9/02 84/380 R |
| 2015/0013522 | A1 * | 1/2015 | Morrison | G10D 9/035 84/383 A |
| 2015/0059552 | A1 * | 3/2015 | Son | G10D 9/02 84/383 A |
| 2017/0011721 | A1 * | 1/2017 | Jeong | G10D 9/02 |

* cited by examiner

LIGATURE FOR A WIND INSTRUMENT

BACKGROUND OF THE INVENTION

The present invention relates in general to reed affixing devices for wind instruments, and, more particularly, to a reed affixing device for a wind instrument, which is intended to secure a reed to a mouthpiece of a wind instrument, such as a saxophone or a clarinet.

Generally, a reed is coupled to a mouthpiece of a wind instrument, such as a saxophone or a clarinet, to produce the sound of the instrument via vibrations. There are various kinds of reeds classified according to the thickness or material used. Further, reeds are capable of making various tones. Thus, different kinds of reeds are used according to the style of music, for example, classical music, jazz or pop.

A ligature is used to secure a reed to a mouthpiece. However, conventional ligatures used to secure a reed to a mouthpiece have a fixed size and are thus suitable only for a specifically sized mouthpiece. Thus, a need still exists for a ligature that is capable of effectively securing a reed to mouthpieces of various sizes and which allows for effective vibrations.

BRIEF SUMMARY OF THE INVENTION

In accordance with a preferred embodiment, the present invention provides a ligature for a wind instrument that includes a cord harness, an adjuster, and a cord. The cord harness includes a plurality of apertures extending transverse to a longitudinal axis of the cord harness. The adjuster connects to and extends transverse to the longitudinal axis of the cord harness. The cord passes through the plurality of apertures in a spiral manner and engages a distal end of the adjuster.

In accordance with another aspect of the preferred embodiment, the present invention provides a wind instrument mouthpiece assembly that includes a mouthpiece, a reed, and a ligature. The ligature secures the reed to the mouthpiece. The ligature includes a cord harness, an adjuster, and a cord. The cord harness includes a plurality of apertures extending transverse to a longitudinal axis of the mouthpiece. The adjuster engages with the cord harness and extends transverse to the longitudinal axis of the mouthpiece. The cord is wound about the mouthpiece, passes through the plurality of apertures, and engages the adjuster.

In accordance with yet another aspect of the preferred embodiment, the present invention provides an adjuster for a ligature of a wind instrument that includes an elongated body and a cord guard. The elongated body includes a front end having a curved surface and a rear end opposite the front end. The cord guard includes a distal end and a posterior end opposite the distal end. The posterior end includes a recess and the front end of the elongated body is engaged with the recess of the cord guard.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
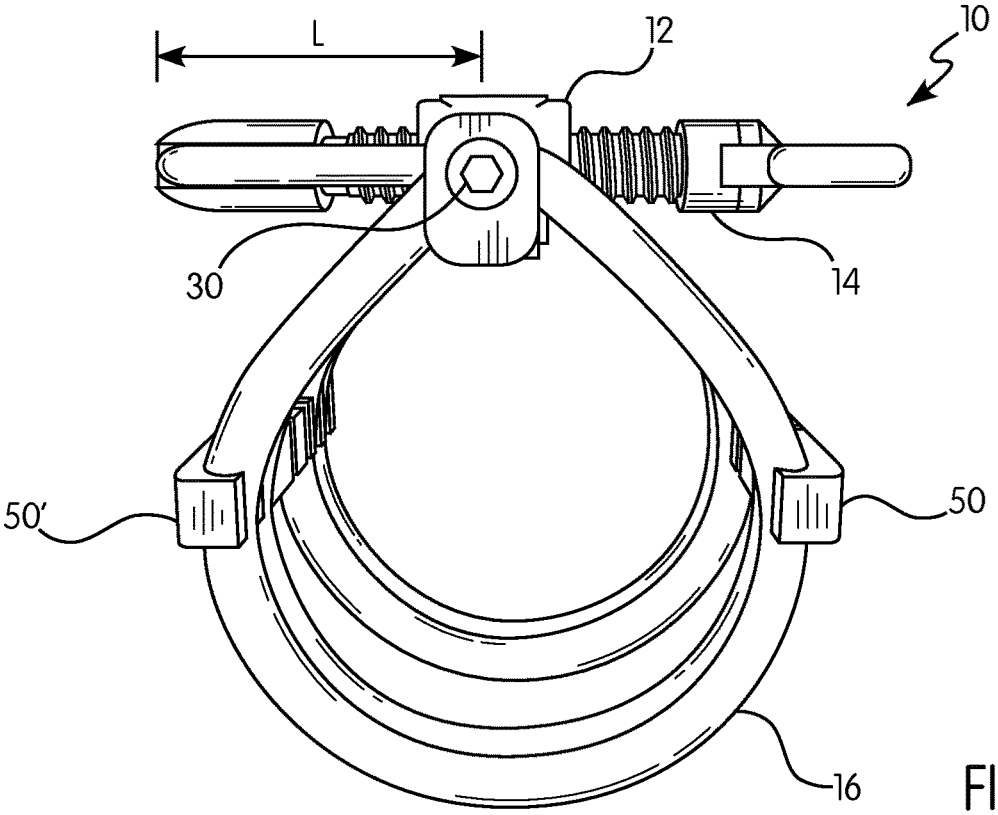
FIG. 1 is a side view of a ligature for a wind instrument in accordance with a preferred embodiment of the present invention.

Reference will now be made in detail to the preferred embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. The term "proximal" shall mean towards the center of an object. The term "distal" shall mean away from the center of an object. Such directional terms used in conjunction with the following description of the drawings should not be construed to limit the scope of the invention in any manner not explicitly set forth.

Certain terminology is used in the following description for convenience only and is not limiting. The words "right," "left," "lower" and "upper" designate directions in the drawings to which reference is made. The words "inwardly" and "outwardly" refer to directions toward and away from, respectively, the geometric center of the identified element and designated parts thereof. Additionally, the term "a," as used in the specification, means "at least one." The terminology includes the words noted above, derivatives thereof and words of similar import.

In accordance with a preferred embodiment, the present invention provides a ligature 10 for a wind instrument, as configured and shown in FIG. 1. The ligature 10 includes a cord harness 12, an adjuster 14, and a cord 16.

Figure 3:
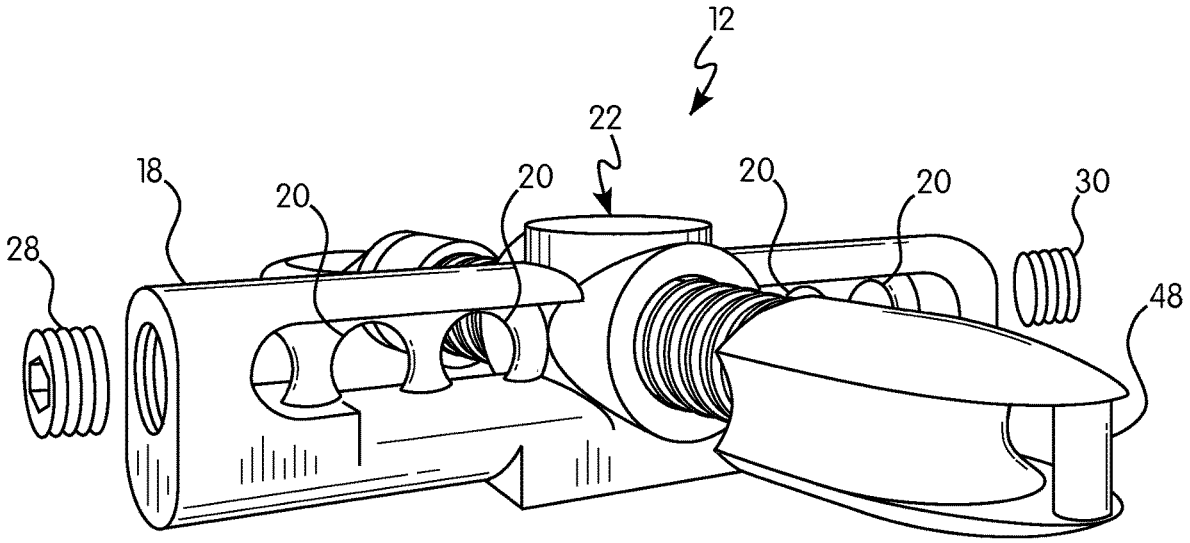
FIG. 3 is a perspective view of a cord harness and adjuster of the ligature of FIG. 1.
Figure 4:
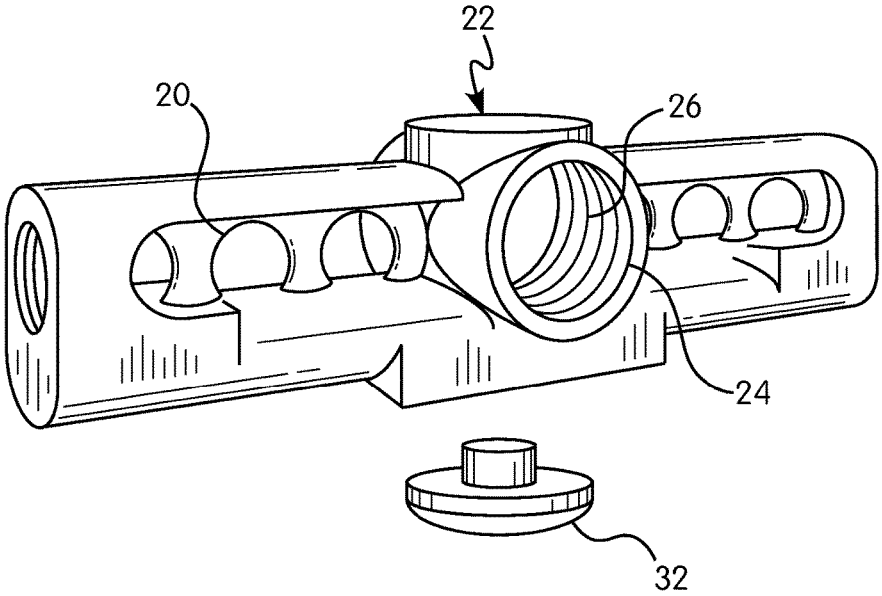
FIG. 4 a perspective view of a cord harness of the ligature of FIG. 1.

The cord harness 12 is configured as best shown in FIGS. 3 and 4, having an elongated body 18 with a plurality of apertures 20. The plurality of apertures 20 are spaced apart and extend along a longitudinal axis or longitudinal direction of the elongated body 18. Preferably, each of the plurality of apertures 20 face in a direction transverse i.e., in a cross direction, to the longitudinal axis of the elongated body e.g., at an acute or obtuse angle or perpendicular to the longitudinal axis. That is, each of the plurality of apertures 20 can face a direction traversing the longitudinal axis for example at a 30, 45 or 70 degree acute angle relative to the longitudinal axis or at a 90 degree angle relative to the longitudinal axis. Each of the plurality of apertures have rounded inner walls or edges to allow for smooth passage of the cord 16 therethrough.

Figure 12:
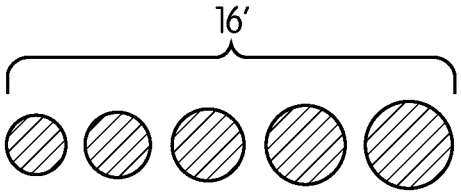
FIG. 12 is a cross-sectional view of a variety of cords applicable to the present invention.

Each of the plurality of apertures is sized sufficiently to accommodate the passage of cords of various thicknesses. Thus, the present embodiment advantageously allows a user to utilize cords of various thicknesses (FIG. 12) to secure a reed to a mouthpiece (see FIG. 8) so as to control or adjust the tone characteristics of a wood instrument mouthpiece. Tone characteristics are controlled or adjusted by varying the thickness of the cord which limits or changes the vibration amplitude and vibration absorbing area of the reed.

About a mid-portion of the cord harness is a receiving member 22 for operatively engaging the adjuster 14, as further described below. The receiving member 22 is preferably configured as a through hole 24 having inner or female threads 26 for threadedly engaging corresponding threads on the adjuster 14. A longitudinal axis of the through hole 24 substantially aligns with the facing direction of the apertures 20 or in a direction transverse to a longitudinal axis of the elongated body 18.

Preferably, the cord harness 12 is configured with three apertures on either side of the receiving member 22.

The cord harness 12 further includes a fastener 28 about its posterior end and a fastener 30 about its anterior end. Each fastener 28, 30 is configured to engage the cord 16 so as to secure the cord to the cord harness. Preferably, each of the fasteners 28, 30 are configured as setscrews for fastening the cord to the cord harness.

Figure 2:
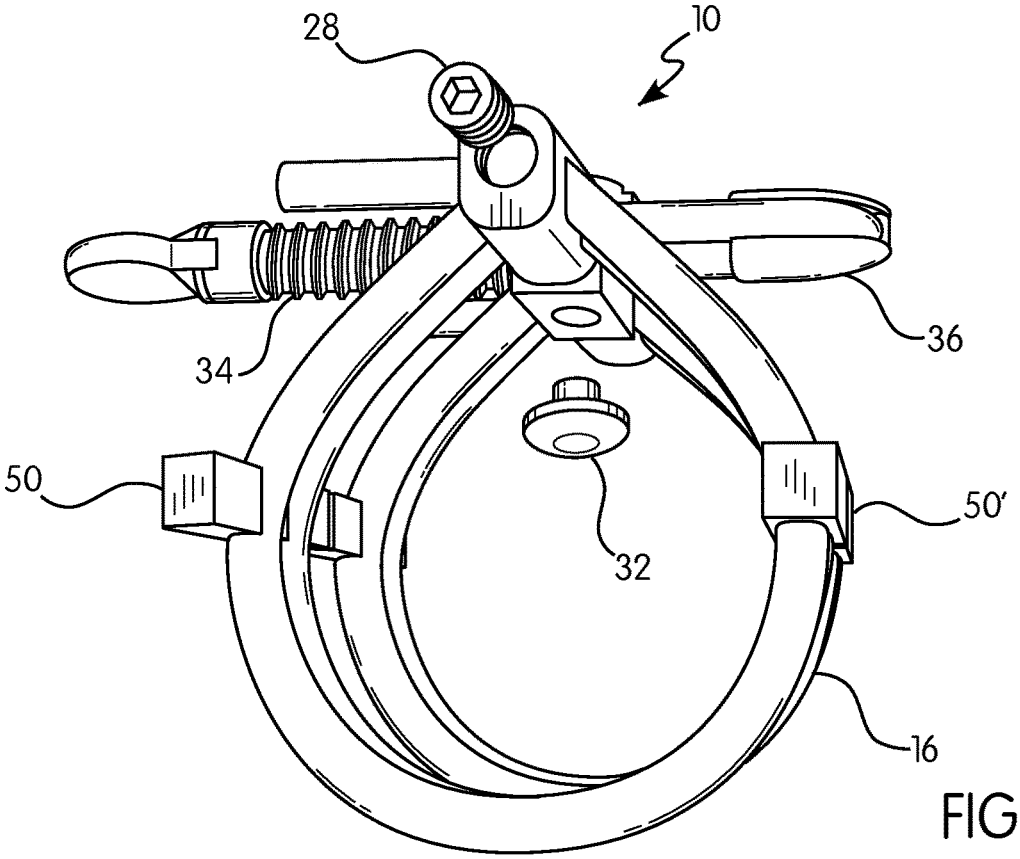
FIG. 2 is a perspective view of the ligature of FIG. 1.

Referring to FIGS. 2 and 4, the cord harness 12 further includes a barrier member 32 about a bottom end of the elongated body 18. Preferably, the barrier member 32 is positioned directly beneath the receiving member 22 and configured as a pliable pad. The barrier member 32 can be formed out of any non-rigid or rigid material sufficient for purposes of providing a protective barrier between the elongated body of the cord harness and a mouthpiece 102 (FIG. 8) upon which the cord harness is to be assembled to. For example, the barrier member can be formed of a polymer, such as silicone.

The adjuster 14 is configured as shown in FIGS. 1, 3, 5 and 6. The adjuster includes an elongated body 34 and a cord guard 36. The elongated body 34 includes a shaft or body having outer or male threads 38 i.e., a threaded shaft or threaded body, for threadedly engaging female threads 26 on the receiving member 22, and a handle 40 about its rear end. The front end of the elongated body 34 opposite the rear end, is configured as a curved surface. Preferably, the front end is configured as a protruding nipple 42 having a rounded end for slidingly engaging in and to the cord guard 36, such that the elongated body is rotatable relative to the cord guard.

The cord guard 36 forms the distal end of the adjuster and attaches to a distal end or front end of the elongated body or threaded body. The cord guard includes a distal end and a posterior end or rear end. The posterior end opposite the distal end includes a recess 37 (FIG. 6) i.e., a female rear end, for receiving the nipple of the elongated body 34. The recess 37 is sized and shaped to slidingly receive and engage the front end or nipple 42 of the elongated body 34. In other words, the front end of the elongated body is engaged with the recess of the cord guard.

Figure 5:
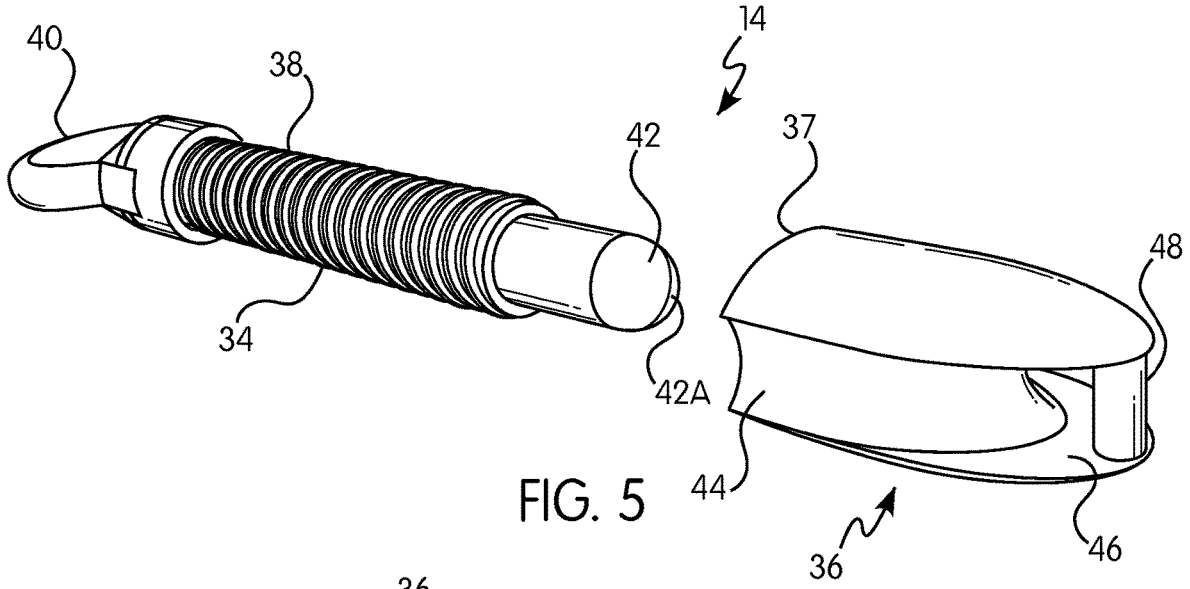
FIG. 5 is an exploded perspective view of an adjuster of the ligature of FIG. 1.
Figure 6:
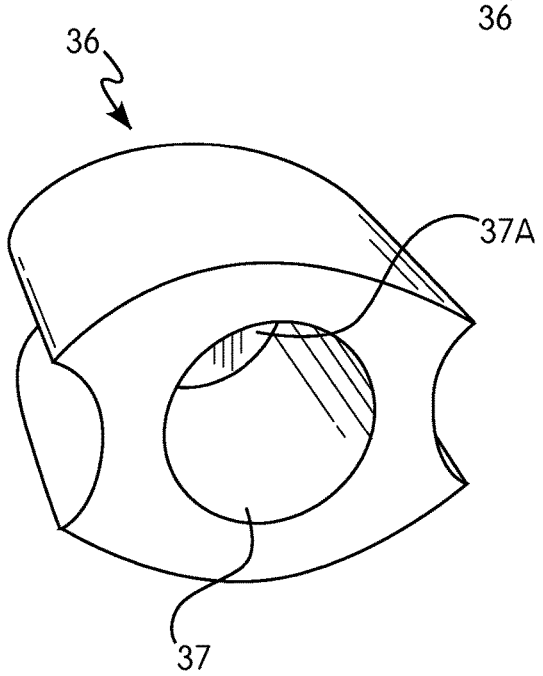
FIG. 6 is a rear perspective of a cord guard of the adjuster of FIG. 5.
Figure 6A:
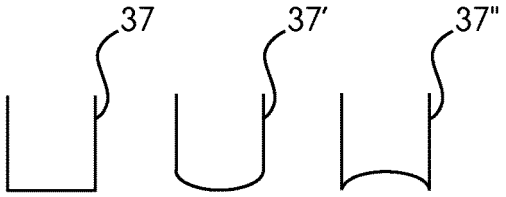
FIG. 6A a schematic cross-sectional side view of alternative configurations of a recess for a cord guard of the ligature of FIG. 1.

Referring to FIGS. 5, 6 and 6A, the recess 37 can be configured as a counterbore 37. As such, the recess includes a planar surface 37A that directly engages a most distal end 42A of the front end of the elongated body 34. This configuration of the elongated body and cord guard minimizes frictional contact between the nipple 42 and the recess 37 so as to allow sufficient rotation of the elongated body relative to the cord guard by a user rotating the elongated body. In other words, once the nipple 42 is received within the recess 37, the nipple can rotate freely therein so as to allow the elongated body 34 to rotate within the receiving member 22 without causing the cord guard 36 to rotate. That is, the cord guard 36 remains in a rotationally stationary position while the elongated body is threadedly engaging the receiving member.

Alternatively, as shown in cross-section in FIG. 6A, the recess can be configured to have a complementary shape 37' to that of the nipple, such as a concave shape, or a recess having a convex shape 37", such as a spherical convex shape at a bottom of the recess.

The front end of the cord guard 36 includes a recessed path 44 for receiving and guiding the cord 16 therethrough. The recessed path 44 extends along a path from one lateral side, across a distal end of the cord guard, to an opposite lateral side.

The threaded engagement of the adjuster 14 with the receiving member 22 allows for a distance "L" (FIG. 1) from the receiving member to a distal end of the adjuster to be adjusted according to a user preference. Thus, the overall size or diameter of the cord assembled to the cord harness can be adjusted by adjusting the position of the adjuster relative to the cord harness.

About the distal end of the cord guard 36 is configured a through hole 46 for the passage of the cord 16 therethrough. The through hole 46 is formed by a portion of the recessed path 44 and a retaining member 48 spaced from the recessed path. The retaining member 48 facilitates maintaining the cord in position during assembly. In general, the cord guard 36 has an overall shape similar to that of a bullet-nose.

Referring back to FIG. 2, the cord 16 is assembled to the cord harness by being spirally wound through the apertures 20 starting from the most anterior aperture or the most posterior aperture. In threading the cord through the cord harness, the cord is initially threaded in the same direction in which the adjuster 14 is pointing. For example, FIG. 2 illustrates a posterior perspective view of the ligature 10 in which a cord is initially threaded through the most posterior aperture of the cord harness in a clockwise direction i.e., a first direction, until it reaches the adjuster 14. Then the cord is positioned along recessed path 44 and threaded through the through hole 46. Afterwards, the cord is threaded through the next adjacent aperture in a counter clockwise direction i.e., a second direction opposite the first direction, until it passes through all remaining apertures 20. The fasteners 28, 30 are then assembled to secure the cord to the cord harness.

While the overall length of the cord effectively utilized to secure a reed to a mouthpiece can vary, once the fasteners 28, 30 are secured the total effective length of the cord is fixed. That is, the overall length of the cord from its attachment points at fasteners 28 and 30 utilized to secure a reed to a mouthpiece is fixed.

The cord 16 is a flexible elongated member. Preferably, the cord 16 is a string made from a textile or synthetic fiber, such as Kevlar® material manufactured by Du Pont of Wilmington, Del. The cord 16 can also be elastic or non-elastic.

Figure 7:
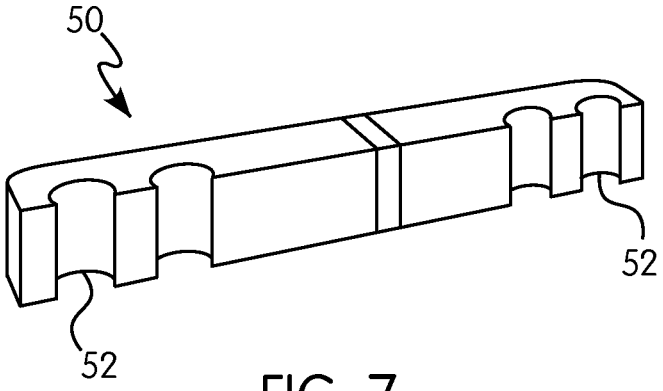
FIG. 7 is a perspective view of a sound adjusting positioner of the ligature of FIG. 1.

The ligature 10 further includes a sound adjusting positioner 50, as best shown and configured in FIGS. 1, 2 and 7. The sound adjusting positioner 50 includes a plurality of recesses 52 that are spaced apart, sized and configured to receive the cord 16 so as to be movable or positionable about various positions along the length of the spirally wound cord. Preferably, the ligature 10 includes a pair of sound adjusting positioners, but can alternatively include more than two, such as three, four, five or more sound adjusting positioners. The sound adjusting positioner is spaced from the cord harness and the cord passes through at least one of the plurality of recesses.

The sound adjusting positioner 50 serves to adjust the length of the vibration absorbing region of the cord 16. That is, if the sound adjusting positioner 50 is moved closer towards a reed, it absorbs a small amount of vibrations from the reed. Meanwhile, if the sound adjusting positioner 50 is moved further away from the reed, it absorbs a relatively larger amount of vibrations from the reed.

In accordance with an aspect of the present embodiment, the present invention provides a wind instrument mouthpiece assembly 100, as configured and shown in FIGS. 8-11. The mouthpiece assembly 100 includes a mouthpiece 102, a reed 104, and the ligature 10. The ligature 10 secures the reed to the mouthpiece.

Figure 8:
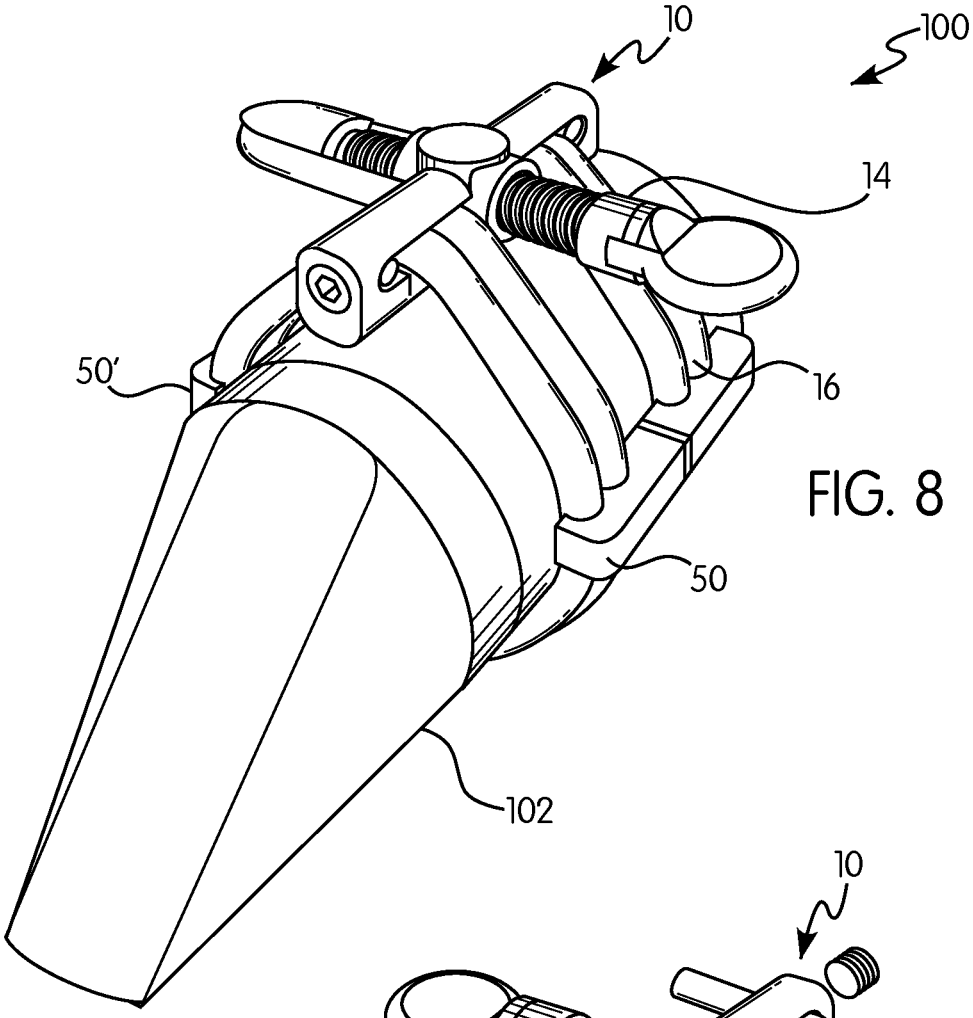
FIG. 8 is a front perspective view of a mouthpiece assembly having the ligature of FIG. 1 assembled to a mouthpiece.
Figure 9:
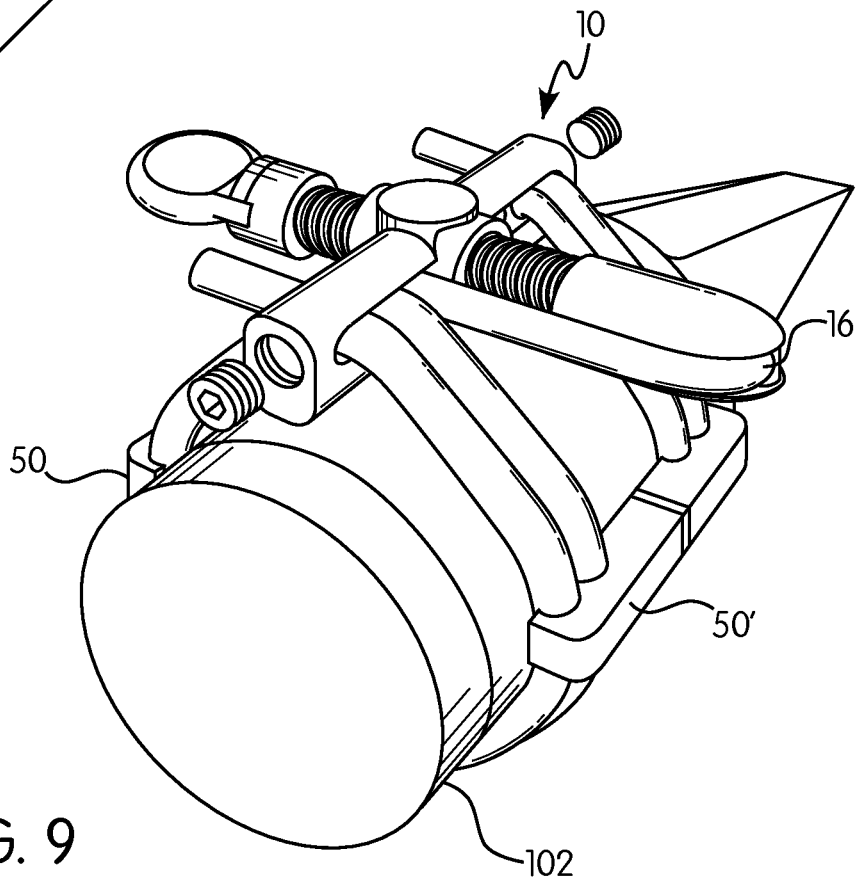
FIG. 9 is a rear perspective view of the mouthpiece assembly of FIG. 8.
Figure 10:
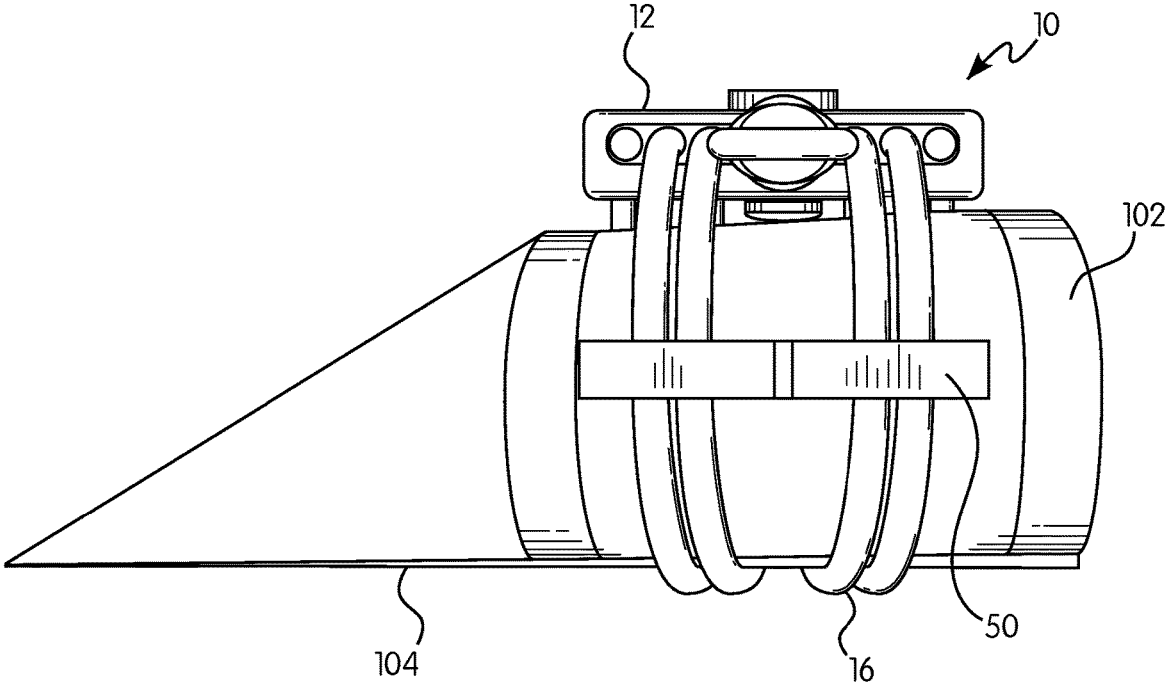
FIG. 10 is a left side view of the mouthpiece assembly of FIG. 8.
Figure 11:
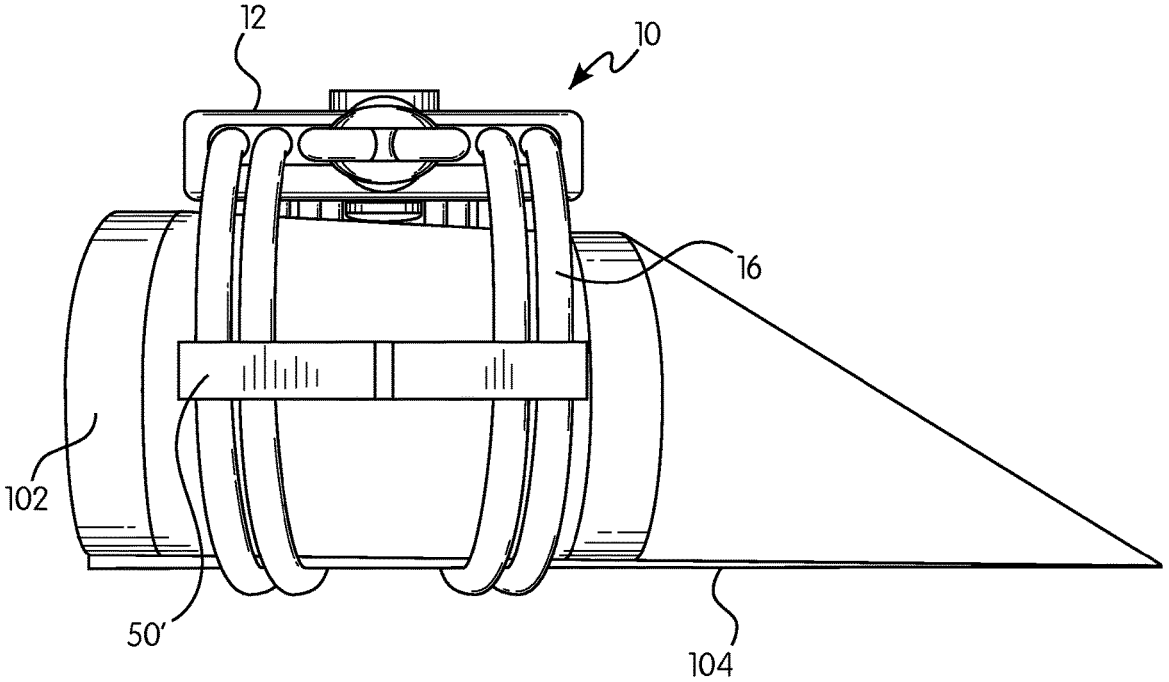
FIG. 11 is a right side view of the mouthpiece assembly of FIG. 8.

Referring to FIG. 8, the ligature 10 is disposed on an upper portion of the mouthpiece 102 with the adjuster 14 pointed left. However, the adjuster can alternatively be pointed to the right when viewing the mouthpiece in the orientation as shown in FIG. 8. The ligature 10 secures the reed to the mouthpiece by the cord 16 being spirally wound around both the mouthpiece and reed. Once the cord is wound about the mouthpiece and reed, and secured in place by fasteners 28, 30, the adjuster 14 is adjusted to adjust and control the tension on the cord. That is, the opposite ends of the cord are fixedly secured and positioned to the cord harness 12 by fasteners 28, 30 such that the tension on the cord is directly controlled by the distance the distal end of the adjuster extends from the cord harness. In other words, the adjuster 14 is adjustably positionable relative to the cord harness for increasing or decreasing tension on the cord.

A pair of sound adjusting positioners 50, 50' are shown positioned about opposite lateral sides of the mouthpiece. Each sound adjusting positioner controls the position of the cord relative to the cord harness 12, mouthpiece 102, and reed 104. Owing to the configuration of the sound adjusting positioner, the sound adjusting positioner can be adjusted and positioned along the length of the cord so as to change or adjust the brightness of the sound generated by the mouthpiece assembly.

The foregoing ligature 10 advantageously provides for a reed affixing device for a mouthpiece of a wind instrument that can be adjusted in size to accommodate mouthpieces of various sizes and various instruments. Moreover, the ligature provides an adjuster to allow a user to variably adjust the tension of the ligature for effectively controlling and maximizing reed performance.

In accordance with another aspect of the present embodiment, the present invention provides a ligature kit that includes the ligature 10 and a plurality of chords 16' (FIG. 12) having various thicknesses.

It will be appreciated by those skilled in the art that changes could be made to the embodiments described above without departing from the broad inventive concept thereof. It is to be understood, therefore, that the present invention is not limited to the particular embodiments disclosed, but it is intended to cover modifications within the spirit and scope of the present invention as defined by the appended claims.

What is claimed is:

1. A ligature for a wind instrument comprising:
- a cord harness having a plurality of apertures extending transverse to a longitudinal axis of the cord harness;
- an adjuster connected to and adjustably extendable relative to the cord harness; and
- a cord passing through the plurality of apertures in a spiral manner and engaging a distal end of the adjuster.

2. The ligature of claim 1, further comprising a sound adjusting positioner having a plurality of recesses, wherein the sound adjusting positioner is spaced from the cord harness and the cord passes through at least one of the plurality of recesses.

3. The ligature of claim 2, wherein the plurality of recesses of the sound adjusting positioner are spaced apart recesses.

4. The ligature of claim 1, wherein the adjuster comprises a threaded shaft for engaging female threads on the cord harness and a through hole about the distal end for receiving the cord.

5. The ligature of claim 1, wherein the cord harness includes a fastener about each of its anterior and posterior ends for securing the cord to the cord harness.

6. The ligature of claim 1, wherein the cord harness includes a barrier member at a bottom end of the cord harness.

7. The ligature of claim 1, wherein the adjuster comprises:
- an elongated body having a curved surface front end, and
- a cord guard that includes a posterior end having a counterbore recess slidingly engaged with the front end of the elongated body.

8. A wind instrument mouthpiece assembly comprising:
- a mouthpiece;
- a reed; and
- a ligature securing the reed to the mouthpiece, the ligature including:
  - a cord harness having a plurality of apertures extending transverse to a longitudinal axis of the mouthpiece,
  - an adjuster extending through one of the plurality of apertures and adjustably extendable relative to the cord harness, and
  - a cord wound about the mouthpiece, passing through the plurality of apertures, and engaging the adjuster.

9. The wind instrument mouthpiece of claim 8, wherein the adjuster includes:
- a threaded body for threadedly engaging the cord harness; and
- a cord guard about a distal end of the threaded body for engaging the cord.

10. The wind instrument mouthpiece of claim 9, wherein the cord guard includes a through hole for the passage of the cord therethrough.

11. The wind instrument mouthpiece of claim 8, further comprising a sound adjusting positioner having a plurality of recesses, wherein the sound adjusting positioner is spaced from the cord harness and the cord passes through at least one of the plurality of recesses.

12. The wind instrument mouthpiece of claim 11, wherein the sound adjusting positioner is movable relative to the cord.

13. The wind instrument mouthpiece of claim 8, wherein the cord harness includes a fastener about each of its proximal and distal ends for securing the cord to the cord harness.

14. The wind instrument mouthpiece of claim 8, wherein the cord harness includes a barrier member at a bottom end of the cord harness.

15. An adjuster for a ligature of a wind instrument comprising:

an elongated body that includes:

a front end having a curved surface, and a rear end opposite the front end; and a cord guard movable relative to the elongated body, the cord guard including:

a posterior end that includes a recess engaged with the front end of the elongated body, a recessed path, and a retaining member.

16. The adjuster of claim 15, wherein the recess includes a planar surface that directly engages a most distal end of the front end of the elongated body.

17. The adjuster of claim 15, wherein the recess is a counter bore.

18. The adjuster of claim 15, wherein the recess includes a concave surface or a convex surface.

19. The adjuster of claim 15, wherein the elongated body further includes threads along a longitudinal length of the elongated body.

20. The adjuster of claim 15, wherein the front end is configured as a nipple.

21. The adjuster of claim 15, wherein the elongated body is rotatable relative to the cord guard.

22. The adjuster of claim 15, wherein the recessed path extends continuously from a first lateral side of the cord guard to an opposing second lateral side of the cord guard.

23. The adjuster of claim 15, wherein the retaining member extends across a width of the recessed path forming a through hole.

* * * * *